US005972038A

United States Patent [19]

Amestica et al.

[11] Patent Number: 5,972,038

[45] Date of Patent: Oct. 26, 1999

[54] CHELANT ENHANCED PHOTOBLEACHING

[75] Inventors: Luis Alberto Amestica, Las Condes, Chile; Francisco Ramon Figueroa; Jose Andres Rojo, both of Caracas, Venezuela

[73] Assignee: The Procter & Gamble Company, Cincinnati, Ohio

[21] Appl. No.: 08/606,876

[22] Filed: Feb. 26, 1996

Related U.S. Application Data

[63] Continuation-in-part of application No. 08/298,259, Aug. 30, 1994, abandoned.

[51] Int. Cl.[6] ..... D06L 3/04

[52] U.S. Cl. ..... 8/103; 8/107; 510/301; 252/186.1; 252/186.25

[58] Field of Search ..... 252/186.1, 186.25; 8/101, 103, 102, 107; 540/131, 140; 510/301

[56] References Cited

U.S. PATENT DOCUMENTS

| | | | |
|---|---|---|---|
| 3,927,967 | 12/1975 | Speakman | 8/103 |
| 4,033,718 | 7/1977 | Holcombe et al. | 8/103 |
| 4,166,718 | 9/1979 | Reinert et al. | 8/111 |
| 4,217,105 | 8/1980 | Goodman | 8/111 |
| 4,311,605 | 1/1982 | Eckhardt et al. | 510/301 |
| 4,332,691 | 6/1982 | Beavan | 510/237 |
| 4,399,049 | 8/1983 | Gray et al. | 510/301 |
| 4,524,014 | 6/1985 | Finch et al. | 252/188.1 |
| 4,566,874 | 1/1986 | Hölzle et al. | 8/103 |
| 4,585,563 | 4/1986 | Busch et al. | 252/8.8 |
| 4,648,992 | 3/1987 | Graf et al. | 540/124 |
| 4,657,554 | 4/1987 | Reinert et al. | 8/107 |
| 4,704,233 | 11/1987 | Hartman et al. | 510/337 |

FOREIGN PATENT DOCUMENTS

| | | | |
|---|---|---|---|
| 0 119 746 A1 | 9/1984 | European Pat. Off. | C11D 3/00 |
| 3430773 A1 | 3/1985 | Germany | C11D 7/54 |
| 1 372 036 | 10/1974 | United Kingdom | D06F 35/00 |

OTHER PUBLICATIONS

Abstract: JP 58042699, Detergent Composition for Clothes with Enhanced Whitening Power—Contains Sulphonated Aluminium Phthalocyanine and Fluorescent Dye, Kao Corporation. (1981).

*Primary Examiner*—Joseph D. Anthony

*Attorney, Agent, or Firm*—Daniel F. Nesbitt; Milton B. Graff; Donald E. Hasse

[57] ABSTRACT

The performance of photobleaches such as the zinc phthalocyanines is enhanced by means of alkylene amino/carboxylate or alkylene amino/phosphonate chelants. Thus, sulfonated zinc phthalocyanine plus diethylenetriamine pentaacetate provide enhanced photobleaching of laundered fabrics. Detergent compositions comprising the improved photobleach systems are provided.

9 Claims, No Drawings

CHELANT ENHANCED PHOTOBLEACHING

This is a continuation-in-part of application Ser. No. 08/298,259, filed on Aug. 30, 1994 now abandoned.

FIELD OF THE INVENTION

The performance of photobleaches, especially in a fabric cleaning operation, is enhanced by the presence- of chelants and improved whiteness maintenance and dingy soil removal performance are provided.

BACKGROUND OF THE INVENTION

A wide variety of bleaching agents have been suggested for use in laundry and other cleaning compositions. For example, hypochlorite solutions may be used for such purposes, as can various peroxides and peroxide-generating bleaches and bleach activators. Materials such as sodium perborate, sodium percarbonate and the like have become commonplace for use in laundry detergents and other cleaning products.

One class of bleaching agents which are conventionally used under circumstances where laundered fabrics are subjected to concentrated light sources, such as direct sunlight as in a line drying operation, are the photobleaches. These valuable bleaches are relatively mild and safe to fabrics and dyestuffs, yet are quite effective in providing white, bright fabrics. In principle, the action of the photobleach involves the capture of energy from the sunlight and its conversion into a bleaching species on the fabric surface. A variety of such materials, especially those of the zinc phthalocyanine class, have been used commercially in laundry detergents for many years.

One problem associated with the use of any bleach is the ability to remove the impression of "dinginess" on fabrics which have aged. While the source of such dinginess is not known with particularity, it is believed that body soils, vagrant dyesuffs, tenacious soils and the like, eventually build up on fabric surfaces, with the result that the fabrics no longer appear new and white. Accordingly, there is a continuing search by detergent formulators for means to improve bleaching efficacy. For example, bleaches such as sodium perborate and sodium percarbonate have been improved by the use of the so-called bleach activator materials, including molecules such as tetraacetylethylenediamine (TAED), nonanoyloxybenzenesulfonate (NOBS), and the like.

However, with photobleaches very little improvement in performance has been seen, to date. The sulfonated zinc phthalocyanines currently in commercial use are, in general, accepted as providing maximum photobleach performance. Accordingly, the formulator of compositions comprising photobleaches has heretofore been constrained to seek other means for securing improved bleaching and cleaning benefits.

It has now been determined that certain chelating agents will interact with photobleaches to increase their absorbency in the visible light spectrum. While not intending to be limited by theory, it may be speculated that photobleaches in the presence of a chelant appear to form a more active bleach species in solution that can absorb on the fabric surface. During the drying process, this species of "photobleach-chelant" can absorb more energy which is used to activate oxygen to an activated state which will oxidize soils, especially those containing double bonds in their molecular structure. Alternatively, the photobleach-chelant may require less energy per molecule to absorb than does photobleach, alone, to be energized and activate the oxygen species responsible for the bleaching. Whatever the reason, this increased absorbency means that the photobleach will more efficiently and effectively produce the desired bleaching species. Accordingly, it has now surprisingly been determined that photobleaches used in combination with chelants in the manner of the present invention provide improved whiteness maintenance performance.

It is an object of the present invention to provide improved photobleaching, especially of laundered fabrics. It is another object herein to provide improved photobleaching and laundering compositions. These and other objects are secured herein, as will be seen from the following disclosures.

BACKGROUND ART

The use of phthalocyanine photobleach in laundry compositions is described in U.S. Pat. No. 4,033,718.

SUMMARY OF THE INVENTION

The present invention encompasses bleaching compositions comprising a photobleach and a chelant, characterized in that:

(a) said photobleach is present in a concentration range of from about 0.0005% to about 0.05%, by weight; and (b) said chelant is present at a concentration range from about 0.3% to about 10.0%, by weight.

The compositions herein are preferably those wherein said photobleach is a phthalocyanine compound, especially those selected from zinc phthalocyanines and aluminum phthalocyanine, and most preferably are sulfonated phthalocyanines.

The preferred chelants herein are members selected from the group consisting of water-soluble diethylenetriamine pentaacetates, ethylenediamine tetraacetates, diethylenetriamine penta(methylenephosphonates), ethylenediamine tetra(methylenephosphonates), ethylenediamine disuccinates, and mixtures thereof.

The invention also encompasses compositions for laundering fabrics with an improved photobleaching effect, characterized in that they comprise:

(a) from about 0.0005% to about 0.05%, by weight, of a photobleach;

(b) from about 0.3% to about 10.0%, by weight, of a chelant;

(c) at least about 1%, by weight, of a detersive surfactant; and (d) the balance of said composition comprising adjunct detersive ingredients and carriers.

As noted above, in such compositions said photobleach is preferably a phthalocyanine compound, especially zinc phthalocyanines and aluminum phthalocyanines, most preferably sulfonated phthalocyanines.

Also as noted above, such compositions preferably employ a chelant which is a member selected from the group consisting of the diethylenetriamine pentaacetates, ethylenediamine tetraacetates, diethylenetriamine penta (methylenephosphonates), ethylenediamine tetra (methylenephosphonates), ethylenediamine disuccinates, and mixtures thereof.

The invention also encompasses a method for providing improved photobleach activity in an otherwise conventional fabric photobleaching process or fabric laundering process, comprising conducting said bleaching process or laundering process in an aqueous bath concurrently with or followed by exposure of the laundered or bleached fabric to light, especially sunlight, with the proviso that:

(a) a photobleach is present in said bath at a concentration in the range from about 0.02 ppm to about 2.0 ppm; and (b) a chelant is present in said bath at a concentration in the range from about 30 ppm to about 400 ppm.

The preferred photobleaches and chelants for use in said process are as noted above.

The invention also encompasses the sulfonated zinc or aluminum phthalocyanine:chelant complexes, per se, especially the complexes with diethylenetriamine pentaacetate and diethylenetriamine penta(methylenephosphonate), as described more fully hereinafter.

DETAILED DESCRIPTION OF THE INVENTION

All percentages, ratios and preparations herein are by weight, unless otherwise specified. All documents cited are, in relevant part, incorporated herein by reference.

Photobleaches—The phthalocyanine photobleaches employed in the practice of the present invention are described in, for example, U.S. Pat. No. 4,033,718, issued Jul. 5, 1977. They are metal phthalocyanine compounds, the metal preferably having a valence of +2 or +3. These photobleaches are articles of commerce, and are available, for example, under the tradename TINOLUX or as zinc phthalocyanine sulfonate.

The amount of photobleach in the subject invention bleaching or laundrering compositions is from about 0.0005% to about 0.05%, preferably from about 0.001% to about 0.02%, more preferably from about 0.002% to about 0.015%, more preferably still from about 0.003% to about 0.012%.

For the methods of the subject invention, the aqueous bath for the bleaching or laundering processes comprises the photobleach at a concentration of from about 0.02 ppm to about 2.0 ppm, preferably from about 0.1 ppm to about 1.5 ppm, more preferably from about 0.25 ppm to about 1 ppm.

In general, phthalocyanines can be prepared in the manner described by Linstead and coworkers, as reported in "Journal of the Chemical Society" (1936) at p. 1719. As is well-known, unsubstituted metal phthalocyanines are soluble in water to an unusually low degree and are used as pigments. However, water solubility can be achieved to a progressively greater degree by the introduction of hydrophilic groups such as sulfo, carboxy, or other substituent groups into the phthalocyanine molecule. Thus, such water-dispersible or water-soluble phthalocyanines are employed as photobleaches. The introduction of hydrophilic groups is most conveniently done by sulfation, and up to four sulfo groups can be introduced into the phthalocyanine structure by the use of hot oleum. Sulfonated phthalocyanines are useful as direct dyes because they have an affinity for cellulose in the form of either cotton or paper pulp. See, for example, "The Chemistry of Synthetic Dyes and Pigments", edited by H. A. Lubs, Reinhold, N.Y. (1955).

As noted hereinabove, phthalocyanines can be readily sulfonated by heating with oleum. Thus, zinc and aluminum phthalocyanines which are monosulfonated, disulfonated, trisulfonated and tetrasulfonated can be prepared. The trisulfonated and tetrasulfonated species are preferred for use as photobleaches. The zinc tetrasulfonated phthalocyanine and zinc trisulfonated phthalocyanine are most preferred. Further details regarding the synthesis of these especially preferred materials are disclosed in the '718 patent cited above.

Chelants—The chelants (chelating agents) used herein can be any of a wide variety of bidentate or multidentate materials known in the art and in commercial practice for their ability to interact with zinc (preferred) or aluminum. Preferably, such chelants are not merely polycarboxylate materials, such as citrate, but rather are selected from the class of alkylene amino/carboxylate and alkylene amino/phosphonate materials well-known for their use as chelants for various metal cations, especially zinc.

Preferred alkylene amino/carboxylate and alkylene amino/phosphonate chelants include those having the following structure:

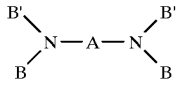

In the structure above, A preferably has the structure $—((CH_2)_a—NB')_b—(CH_2)_a—$ wherein b is an integer from 0 to about 4, preferably 0 or 1 or 2, more preferably 0 or 1. When b is 0, a is an integer from 2 to about 8, preferably from 2 to about 6, more preferably from 2 to about 4, most preferably 2. When b is greater than 0, a is an integer from 2 to about 4, preferably 2. More preferred A is $—(CH_2—CH_2—NB)_b—CH_2—CH_2—$.

In the above structure, each B is selected from carboxylates, preferably succinate or especially acetate, and phosphonates, preferably methylenephosphonate. Each B' is independently B or another moiety, such as hydrogen; hydroxyalkyl, the alkyl having about 1–14 carbon atoms, preferably about 2–6 carbon atoms, especially hydroxyethyl; or alkylcarbonyl, the alkyl having about 8–18 carbon atoms, preferably about 12–18 carbon atoms, e.g., lauroyl, myristoyl, oleoyl, cocoyl. Preferably, at least one B' is B; more preferably no more than one B' is other than B; also preferably all B' are B. Preferably all B are the same moiety.

Preferred chelants include ethylenediamine carboxylates and phosphonates, diethylenetriamine carboxylates and phosphonates, and triethylenetetraamine carboxylates and phosphonates.

Such chelants include, but are not limited to: the diethylenetriamine pentaacetates (DTPA), ethylenediamine tetraacetates (EDTA), diethylenetriamine penta (methylenephosphonates) (DTPMP), ethylenediamine tetra (methylenephosphonates) (EDTMP), ethylenediamine disuccinates (EDDS), and mixtures thereof. Other chelants useful herein include the N-(hydroxyethyl)ethylenediamine triacetates, triethylenetetraamine hexaacetates, N-lauroyl-N, N'-ethylenediamine triacetates, and the like.

All such chelants are used in their water-soluble form, e.g., as sodium, potassium, ammonium, or the like, salts, especially sodium salts.

It may be anticipated that, depending on the pH of the wash solution and the water hardness, certain chelants will be more effective than others. For example, at high hardness (7–25 grains per gallon) and pH 9–11 of the laundry bath, DTPA, EDDS and the phosphonate chelants (e.g., EDTMP and DTPMP) will perform better than EDTA. At low water hardness (0–8 gpg) and low pH 6–9, EDTA will perform as well as the other chelants.

The amount of chelant in the subject invention bleaching or laundering compositions is from about 0.2% to about 10%, preferably from about 0.3% to about 8%, more preferably from about 0.4%, to about 7%, more preferably still from about 0.5% to about 6%, still more preferably from about 0.6% to about 5%, also preferably from about 0.8% to about 3%, also preferably from about 1% to about 4%.

For the methods of the subject invention, the aqueous bath for the bleaching or laundering processes comprises the chelant at a concentration of from about 2 ppm to about 400 ppm, preferably from about 30 ppm to about 350 ppm, more preferably from about 40 ppm to about 300 ppm, also preferably from about 50 ppm to about 250 ppm.

Mole Ratio Photobleach:Chelant—As noted hereinabove, the photobleach and chelants are used in the present compositions and processes herein at the specified weights and percentages. Considered on a mole basis, and having due regard for the consideration of water hardness and pH noted above, the preferred mole ratio of photobleach:chelant used herein is in the range from about 1:10 to about 1:2000; more preferred is a ratio from about 1:20 to about 1:1000; more preferred still is a ratio from about 1:50 to about 1:500. Performance testing shows significantly higher whiteness and dingy removal than either the photobleach or chelant, alone, with this ratio range. Outside this ratio, no special or synergistic chelant-photobleach performance enhancement is observed.

Adjunct Ingredients

Commercial bleaches and fully-formulated detergent compositions, especially those intended for use in laundering fabrics, will typically also comprise various adjunct ingredients to enhance overall cleaning performance, to provide additional fabric care benefits, or to improve the processability and/or aesthetics of the compositions. The following is included for the convenience of the formulator to illustrate such adjunct ingredients, but is not intended to be limiting thereof.

Additional Bleaching Compounds—Bleaching Agents and Bleach Activators

The detergent compositions herein may optionally contain bleaching agents or bleaching compositions containing a bleaching agent and one or more bleach activators which are not of the photobleach type. When present, such bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetrahydrate) can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application Ser. No. 740,446, Burns et al, filed Jun. 3, 1985, European Patent Application 0,133,354, Banks et al, published February 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Percarbonate is available from various commercial sources such as FMC, Solvay and Tokai Denka.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L \text{ or } R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamido-caproyl) oxybenzenesulfonate, (6-nonanamidocaproyl) oxybenzenesulfonate, (6-decanamido-caproyl) oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

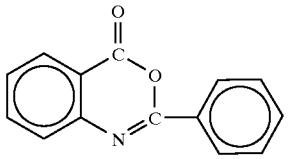

Still another class of preferred bleach activators includes the acyl lactam activators, especially acyl caprolactams and acyl valerolactams of the formulae:

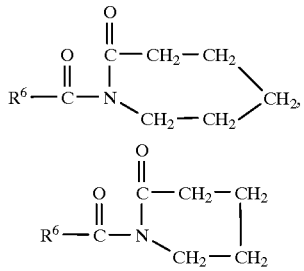

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate.

If desired, the bleaching compounds can be catalyzed by means of a manganese compound. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and European Pat. App. Pub. Nos. 549,271A1, 549,272A1, 544,440A2, and 544,490A1; Preferred examples of these catalysts include $Mn^{IV}_2(u\text{-}O)_3$(1,4,7-trimethyl-1,4,7-triazacyclononane)$_2(PF_6)_2$, $Mn^{III}_2(u\text{-}O)_1(u\text{-}OAc)_2$(1,4,7-trimethyl-1,4,7-triazacyclononane)$_2$-$(ClO_4)_2$, $Mn^{IV}_4(u\text{-}O)_6$(1,4,7-triazacyclononane)$_4(ClO_4)_4$, $Mn^{III}Mn^{IV}_4(u\text{-}O)_1(u\text{-}OAc)_2$-(1,4,7-trimethyl-1,4,7-triazacyclononane)$_2(ClO_4)_3$, $Mn^{IV}$(1,4,7-trimethyl-1,4,7-triazacyclononane)-$(OCH_3)_3(PF_6)$, and mixtures thereof. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos.: 4,728,455; 5,284,944; 5,246,612; 5,256,779; 5,280,117; 5,274,147; 5,153,161; and 5,227,084.

As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm, of the catalyst species in the laundry liquor.

Detersive Surfactants—Nonlimiting examples of surfactants useful herein typically at levels from about 1 % to about 55%, by weight, include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10\text{-}18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. Oleoyl sarcosinate and other known $C_{12}$–$C_{18}$ sarcosinates may also be used. If high sudsing is desired, the branched-chain $C_{10}$–$C_{16}$ soaps may be used. Mixtures of anionic and nonionic surfactants are especially useful. Other conventional useful surfactants are listed in standard texts.

Enzymes—Enzymes can be included in the formulations herein for a wide variety of fabric laundering purposes, including removal of protein-based, carbohydrate-based, or triglyceride-based stains, for example, and for the prevention of refugee dye transfer, and for fabric restoration. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

Amylases include, for example, α-amylases described in British Patent Specification No. 1,296,839 (Novo), RAPIDASE, International Bio-Synthetics, Inc. and TERMAMYL and BAN, NOVO Industries.

The cellulase usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander). suitable cellulases are also disclosed in GB-A-2.075.028; GB-A-2.095.275 and DE-OS-2.247.832. CAREZYME (Novo) is especially useful.

Suitable lipase enzymes for detergent usage include those produced by microorganisms of the Pseudomonas group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum*, e.g. *Chromobacter viscosum var. lipolyticum* NRRLB 3673, commercially available from Toyo Jozo Co., Tagata, Japan; and further Chromobacter viscosum lipases from U.S. Biochemical Corp., U.S.A. and Disoynth Co., The Netherlands, and lipases ex *Pseudomonas gladioli*. The LIPOLASE enzyme derived from *Humicola lanuginosa* and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Builders—Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least about 1% builder. Liquid formulations typically comprise from about 5% to about 50%, more typically about 5% to about 30%, by weight, of detergent builder. Granular formulations typically comprise from about 10% to about 80%, more typically from about 15% to about 50% by weight, of the detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric metaphosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}\cdot yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-1 1, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z(zAlO_2)_y]\cdot xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$Na_{12}[(AlO_2)_{12}(SiO_2)_{12}(SiO_2)_{12}]\text{-}xH_2O$ wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1, 3, 5-trihydroxy benzene-2, 4, 6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Enzyme Stabilizers—The enzymes employed herein are stabilized by the presence of water-soluble sources of calcium and/or magnesium ions in the finished compositions which provide such ions to the enzymes. (Calcium ions are generally somewhat more effective than magnesium ions and are preferred herein if only one type of cation is being used.) Additional stability can be provided by the presence of various other art-disclosed stabilizers, especially borate species: see Severson, U.S. Pat. No. 4,537,706. Typical detergents, especially liquids, will comprise from about 1 to about 30, preferably from about 2 to about 20, more preferably from about 5 to about 15, and most preferably from about 8 to about 12, millimoles of calcium ion per liter of finished composition. This can vary somewhat, depending on the amount of enzyme present and its response to the calcium or magnesium ions. The level of calcium or magnesium ions should be selected so that there is always some minimum level available for the enzyme, after allowing for complexation with builders, fatty acids, etc., in the composition. Any water-soluble calcium or magnesium salt can be used as the source of calcium or magnesium ions, including, but not limited to, calcium chloride, calcium sulfate, calcium malate, calcium maleate, calcium hydroxide, calcium formate, and calcium acetate, and the corresponding magnesium salts. A small amount of calcium ion, generally from about 0.05 to about 0.4 millimoles per liter, is often also present in the composition due to calcium in the enzyme slurry and formula water. In solid detergent compositions the formulation may include a sufficient quantity of a water-soluble calcium ion source to provide such amounts in the laundry liquor. In the alternative, natural water hardness may suffice.

It is to be understood that the foregoing levels of calcium and/or magnesium ions are sufficient to provide enzyme stability. More calcium and/or magnesium ions can be added to the compositions to provide an additional measure of grease removal performance. Accordingly, as a general proposition the compositions herein will typically comprise from about 0.05% to about 2% by weight of a water-soluble source of calcium or magnesium ions, or both. The amount can vary, of course, with the amount and type of enzyme employed in the composition.

The compositions herein may also optionally, but preferably, contain various additional stabilizers, especially borate-type stabilizers. Typically, such stabilizers will be used at levels in the compositions from about 0.25% to about 10%, preferably from about 0.5% to about 5%, more preferably from about 0.75% to about 3%, by weight of boric acid or other borate compound capable of forming boric acid in the composition (calculated on the basis of boric acid). Boric acid is preferred, although other compounds such as boric oxide, borax and other alkali metal borates (e.g., sodium ortho, meta- and pyroborate, and sodium pentaborate) are suitable. Substituted boric acids (e.g., phenylboronic acid, butane boronic acid, and p-bromo phenylboronic acid) can also be used in place of boric acid.

Clay Soil Removal/Anti-redeposition Agents—The compositions of the present invention can also optionally contain water-soluble ethoxylated amines having clay soil removal and antiredeposition properties. Granular detergent compositions which contain these compounds typically contain from about 0.01% to about 10.0% by weight of the water-soluble ethoxylates amines; liquid detergent compositions typically contain about 0.01 % to about 5%.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal-antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. Another type of preferred antiredeposition agent includes the carboxy methyl cellulose (CMC) materials. These materials are well known in the art.

Suds Suppressors—Compounds for reducing or suppressing the formation of suds can be incorporated into the compositions of the present invention. Suds suppression can be of particular importance in the so-called "high concentration cleaning process" as described in U.S. Pat. Nos. 4,489,455 and 4,489,574 and in front-loading European-style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., K, Na, and Li) phosphates and phosphate esters. The hydrocarbons such as paraffin and haloparaffin can be utilized in liquid form. The liquid hydrocarbons will be liquid at room temperature and atmospheric pressure, and will have a pour point in the range of about −40° C. and about 50° C., and a minimum boiling point not less than about 110° C. (atmospheric pressure). It is also known to utilize waxy hydrocarbons, preferably having a melting point below about 100° C. The hydrocarbons constitute a preferred category of suds suppressor for detergent compositions. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin," as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779, issued May 5, 1981 to Gandolfo et al and European Patent Application No. 89307851.9, published Feb. 7, 1990, by Starch, M. S.

Other silicone suds suppressors are disclosed in U.S. Pat. No. 3,455,839 which relates to compositions and processes for defoaming aqueous solutions by incorporating therein small amounts of polydimethylsiloxane fluids.

Mixtures of silicone and silanated silica are described, for instance, in German Patent Application DOS 2,124,526. Silicone defoamers and suds controlling agents in granular detergent compositions are disclosed in U.S. Pat. No. 3,933,672, Bartolotta et al, and in U.S. Pat. No. 4,652,392, Baginski et al, issued Mar. 24, 1987.

An exemplary silicone based suds suppressor for use herein is a suds suppressing amount of a suds controlling agent consisting essentially of:

(i) polydimethylsiloxane fluid having a viscosity of from about 20 cs. to about 1,500 cs. at 25° C.;

(ii) from about 5 to about 50 parts per 100 parts by weight of (i) of siloxane resin composed of $(CH_3)_3SiO_{1/2}$ units of $SiO_2$ units in a ratio of from $(CH_3)_3$ $SiO_{1/2}$ units and to $SiO_2$ units of from about 0.6:1 to about 1.2:1; and (iii) from about 1 to about 20 parts per 100 parts by weight of (i) of a solid silica gel.

In the preferred silicone suds suppressor used herein, the solvent for a continuous phase is made up of certain polyethylene glycols or polyethylene-polypropylene glycol copolymers or mixtures thereof (preferred), or polypropylene glycol. The primary silicone suds suppressor is branched/crosslinked and preferably not linear.

To illustrate this point further, typical liquid laundry detergent compositions with controlled suds will optionally comprise from about 0.001 to about 1, preferably from about 0.01 to about 0.7, most preferably from about 0.05 to about 0.5, weight % of said silicone suds suppressor, which comprises (1) a nonaqueous emulsion of a primary antifoam agent which is a mixture of (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates; (2) at least one nonionic silicone surfactant; and (3) polyethylene glycol or a copolymer of polyethylene-polypropylene glycol having a solubility in water at room temperature of more than about 2 weight %; and without polypropylene glycol. Similar amounts can be used in granular compositions, gels, etc. See also U.S.

Pat. Nos. 4,978,471, Starch, issued Dec. 18, 1990, and 4,983,316, Starch, issued Jan. 8, 1991, 5,288,431, Huber et al., issued Feb. 22, 1994, and U.S. Pat. Nos. 4,639,489 and 4,749,740, Aizawa et al at column 1, line 46 through column 4, line 35.

The silicone suds suppressor herein preferably comprises polyethylene glycol and a copolymer of polyethylene glycol/polypropylene glycol, all having an average molecular weight of less than about 1,000, preferably between about 100 and 800. The polyethylene glycol and polyethylene/polypropylene copolymers herein have a solubility in water at room temperature of more than about 2 weight %, preferably more than about 5 weight %.

The preferred solvent herein is polyethylene glycol having an average molecular weight of less than about 1,000, more preferably between about 100 and 800, most preferably between 200 and 400, and a copolymer of polyethylene glycol/polypropylene glycol, preferably PPG 200/PEG 300. Preferred is a weight ratio of between about 1:1 and 1:10, most preferably between 1:3 and 1:6, of polyethylene glycol:copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide, like PLURONIC L101.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol+silicone at a weight ratio of 1:5 to 5:1.

For any detergent compositions to be used in automatic laundry washing machines, suds should not form to the extent that they overflow the washing machine. Suds suppressors, when utilized, are preferably present in a "suds suppressing amount". By "suds suppressing amount" is meant that the formulator of the composition can select an amount of this suds controlling agent that will sufficiently control the suds to result in a low-sudsing laundry detergent for use in automatic laundry washing machines.

The compositions herein will generally comprise from 0% to about 5% of suds suppressor. When utilized as suds suppressors, monocarboxylic fatty acids, and salts therein, will be present typically in amounts up to about 5%, by weight, of the detergent composition. Preferably, from about 0.5% to about 3% of fatty monocarboxylate suds suppressor is utilized. Silicone suds suppressors are typically utilized in amounts up to about 2.0%, by weight, of the detergent composition, although higher amounts may be used. This upper limit is practical in nature, due primarily to concern with keeping costs minimized and effectiveness of lower amounts for effectively controlling sudsing. Preferably from about 0.01% to about 1% of silicone suds suppressor is used, more preferably from about 0.25% to about 0.5%. As used herein, these weight percentage values include any silica that may be utilized in combination with polyorganosiloxane, as well as any adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions.

Fabric Softeners—Various through-the-wash fabric softeners, especially the impalpable smectite clays of U.S. Pat. No. 4,062,647, Storm and Nirschl, issued Dec. 13, 1977, as well as other softener clays known in the art, can optionally be used typically at levels of from about 0.5% to about 10% by weight in the present compositions to provide fabric softener benefits concurrently with fabric cleaning. Clay softeners can be used in combination with amine and cationic softeners as disclosed, for example, in U.S. Pat. No. 4,375,416, Crisp et al, Mar. 1, 1983 and U.S. Pat. No. 4,291,071, Harris et al, issued Sep. 22, 1981.

Polymeric Soil Release Agent—Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–C6 alkylene segments, or mixtures therein, (iii) poly (vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents useful in the present invention also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterized by poly(vinyl ester) hydrophobe segments include graft copolymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN type of material, e.g., SOKALAN HP-22, available from BASF (West Germany).

One type of preferred soil release agent is a copolymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another preferred polymeric soil release agent is a polyester with repeat units of ethylene terephthalate units contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from Dupont) and MILEASE T (from ICI). See also U.S. Pat. No. 4,702,857, issued Oct. 27,1987 to Gosselink.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Preferred polymeric soil release agents also include the soil release agents of U.S. Pat. No. 4,877,896, issued Oct. 31, 1989 to Maldonado et al, which discloses anionic, especially sulfoaroyl, end-capped terephthalate esters.

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate. Said soil release agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof.

If utilized, soil release agents will generally comprise from about 0.01% to about 10.0%, by weight, of the detergent compositions herein, typically from about 0.1% to about 5%, preferably from about 0.2% to about 3.0%.

Dye Transfer Inhibiting Agents—The compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: $R—A_x—P$; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

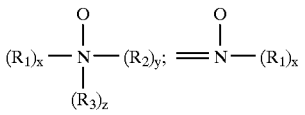

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the detergent compositions herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis,* Vol 113. "Modern Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present invention compositions also may employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

The detergent compositions herein may also optionally contain from about 0.005% to 5% by weight of certain types of hydrophilic optical brighteners which also provide a dye transfer inhibition action. If used, the compositions herein will preferably comprise from about 0.01% to 1% by weight of such optical brighteners.

The hydrophilic optical brighteners useful in the present invention are those having the structural formula:

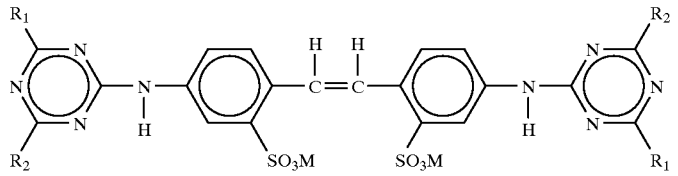

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

The specific optical brightener species selected for use in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous wash solutions than does either of these two detergent composition components when used alone. Without being bound by theory, it is believed that such brighteners work this way because they have high affinity for fabrics in the wash solution and therefore deposit relatively quick on these fabrics. The extent to which brighteners deposit on fabrics in the wash solution can be defined by a parameter called the "exhaustion coefficient". The exhaustion coefficient is in general as the ratio of a) the brightener material deposited on fabric to b) the initial brightener concentration in the wash liquor. Brighteners with relatively high exhaustion coefficients are the most suitable for inhibiting dye transfer in the context of the present invention.

Brightener—Of course, it will be appreciated that other, conventional optical brightener types of compounds can optionally be used in the present compositions to provide conventional fabric "brightness" benefits, rather than a true dye transfer inhibiting effect. Such usage is conventional and well-known in detergent formulations. Any optical brighteners or other brightening or whitening agents known in the art can be incorporated at levels typically from about 0.05% to about 1.2%, by weight, into the detergent compositions herein. Commercial optical brighteners which may be useful in the present invention can be classified into subgroups, which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM;

available from Ciba-Geigy; Artic White CC and Artic White CWD, available from Hilton-Davis, located in Italy; the 2-(4-stryl-phenyl)-2H-napthol[1,2-d]triazoles; 4,4'-bis- (1,2, 3-triazol-2-yl)-stil- benes; 4,4'-bis(stryl)bisphenyls; and the aminocoumarins. Specific examples of these brighteners include 4-methyl-7-diethyl-amino coumarin; 1,2-bis(-venzimidazol-2-yl)ethylene; 1,3-diphenyl-phrazolines; 2,5-bis(benzoxazol-2-yl)thiophene; 2-strylnapth-[1,2-d] oxazole; and 2-(stilbene-4-yl)-2H-naphtho- [1,2-d]triazole. See also U.S. Pat. No. 3,646,015, issued Feb. 29, 1972 to Hamilton. Anionic brighteners are preferred herein.

The following illustrates the advantages achieved by the practice of the present invention.

Whiteness Performance

I. Terry and cotton fabrics are compared for whiteness in a multicycle wash. The wash solutions are: (A) zinc phthalocyanine sulfonate (ZPS) solution at 0.5 ppm concentration; (B) zinc phthalocyanine sulfonate (ZPS) solution at 0.5 ppm concentration with added 40 ppm of pentasodium diethylenetriamine pentaacetate salt (DTPA), and (C) zinc phthalocyanine sulfonate (ZPS) solution at 0.5 ppm concentration with added 80 ppm of pentasodium diethylenetriamine pentaacetate salt (DTPA).

Procedure: White terry and cotton swatches (three internal and two external comparisons) are soaked for 30 minutes in their respective solution and then agitated for 15 minutes. A miniwasher is used for this test. The water hardness is 12 grains per gallon. The fabrics are rinsed and line dried under natural light in the shadow.

Whiteness Measurement: The terry and cotton fabrics are compared for whiteness using: (a) expert panel of three graders using visual grading by panelists on a Panel Score Unit (PSU) scale; (b) variation in the L value given by a ColorQuest Colorimeter made by HunterLab; and (c) variation in the Whiteness Index (WI, ASTM E313).

Results indicate that adding DTPA to the ZPS containing wash solution significantly improves whiteness performance as shown by significant Panel Score Unit and large delta L and Whiteness Index differences.

Results:

| | Wash Solution Composition (ppm) | | |
|---|---|---|---|
| | A | B | C |
| ZPS | 0.50 | 0.50 | 0.50 |
| DTPA | 0.00 | 40.00 | 80.00 |

Whiteness Measured by an Expert Panel:

| | Panel Score Unit (PSU) | |
|---|---|---|
| Test Solution | B | C |
| Control Solution | A | A |
| Cotton: | | |
| First wash cycle | 1.00s | 0.66 |
| Fourth wash cycle | 1.33s | 1.89s |
| Fifth wash cycle | 1.55s | 1.50s |
| Terry: | | |
| First wash cycle | 1.56s | 1.22s |
| Fourth wash cycle | 2.22s | 2.22s |
| Fifth wash cycle | 2.44s | 2.78s |

-continued

Whiteness Measured as Delta L:

| | L(B) - L(A) | L(C) - L(A) |
|---|---|---|
| Cotton: | | |
| First wash cycle | 0.39 | 0.31 |
| Fourth wash cycle | 0.46 | 0.35 |
| Terry: | | |
| First wash cycle | 1.22 | 0.42 |
| Fourth wash cycle | 1.20 | 1.33 |

s: means significant differences versus control

L value represents the color variation from black (0) to white (100). A positive delta-L (IA) means that B is whiter than A.

Whiteness Measured as Delta Whiteness Index (WI):

| | WI(B) - WI(A) | WI(C) - WI(A) |
|---|---|---|
| Cotton: | | |
| First wash cycle | 2.71 | 2.66 |
| Fourth wash cycle | 2.85 | 2.30 |
| Terry: | | |
| First wash cycle | 6.61 | 6.67 |
| Fourth wash cycle | 7.03 | 8.51 |

A positive delta WI (B-A) indicates that B is whiter than A.

II. Terry whiteness tracers are washed in 2000 ppm detergent solution into which is added: (A) 0.5 ppm of zinc phthalocyanine sulfonate (ZPS), (B) 50 ppm of pentasodium diethylenetriamine pentaacetate salt (DTPA), and (C) 0.5 ppm zinc phthalocyanine sulfonate (ZPS) and 50 ppm of pentasodium diethylenetriamine pentaacetate salt (DTPA).

Procedure: Terry swatches (three internal and two external comparisons) are soaked for 30 minutes in their respective solutions and then agitated for 15 minutes. A miniwasher is used for this test. The water hardness is 12 grains per gallon. The fabrics are rinsed and line dried under natural light in the shadow.

Whiteness Measurement: The terry fabrics are compared for whiteness using: (a) expert panel of three graders using Panel Score Unit (PSU) scale; (b) variation in the L value given by a ColorQuest Colorimeter made by HunterLab; and (c) variation in the Whiteness Index (WI, ASTM E313).

Results indicate that adding DTPA to the ZPS containing wash solution significantly improves whiteness performance as shown by significant Panel Score Unit and large delta L and Whiteness Index differences.

Results:

| | Wash Solution Composition (ppm) | | |
|---|---|---|---|
| | A | B | C |
| Detergent | 1200 | 1200 | 1200 |
| ZPS | 0.50 | 0.00 | 0.50 |
| DTPA | 0.00 | 50.00 | 50.00 |

-continued

| Whiteness Measured by an Expert Panel: | | |
|---|---|---|
| | Panel Score Unit (PSU) | |
| Test Solution | B | C |
| Control Solution | A | A |
| First wash cycle | 0.44 | 2.11s |
| Third wash cycle | −0.50 | 2.00s |

| Whiteness Measured as Delta L: | | | |
|---|---|---|---|
| | L(A) | L(B) | L(C) |
| Initial | 91.00 | 91.00 | 90.53 |
| | | L(B) - L(A) | L(C) - L(A) |
| First wash cycle | | 0.87 | 0.66 |
| Third wash cycle | | 0.33 | 0.52 |

s: means significant differences versus control

L value represents the color variation from black (0) to white (100). A positive delta-L (B-A) means that B is whiter than A.

| Whiteness Measured as Delta Whiteness Index (WI): | | | |
|---|---|---|---|
| | L(A) | L(B) | L(C) |
| Initial | 90.68 | 90.91 | 89.72 |
| | | L(B) - L(A) | L(C) - L(A) |
| First wash cycle | | 1.97 | 1.87 |
| Third wash cycle | | 1.32 | 1.17 |

A positive delta WI (B-A) indicates that B is whiter than A.

DINGY REMOVAL PERFORMANCE

Dingy towel tracers are washed to assess chelant-photobleach benefits on dingy removal. Dingy towels are washed in 2000 ppm detergent solution into which is added: (A) Control; no ZPS, no DTPA; (B) 0.5 ppm of zinc phthalocyanine sulfonate (ZPS), (C) 50 ppm of pentasodium diethylenetriamine pentaacetate salt (DTPA), and (D) 0.5 ppm zinc phthalocyanine sulfonate (ZPS) and 50 ppm of pentasodium diethylenetriamine pentaacetate salt (DTPA).

Procedure: Dingy towel swatches (three internal and two external comparisons) are soaked for 30 minutes in their respective solutions and then agitated for 15 minutes. A miniwasher is used for this test. The water hardness is 12 grains per gallon. The fabrics are rinsed and line dried under natural light in the shadow.

Cleaning Measurement: The dingy towel tracers are compared for cleaning using: (a) expert panel of three graders using Panel Score Unit (PSU) scale; (b) variation in the L value given by a ColorQuest Colorimeter made by Hunter-Lab; and (c) variation in the Whiteness Index (WI, ASTM E313).

Results indicate that adding DTPA to the ZPS containing wash solution significantly improves dingy cleaning performance as shown by significant Panel Score Unit and large delta L and Whiteness Index differences.

| Results: | | | | |
|---|---|---|---|---|
| | Wash Solution Composition (ppm) | | | |
| | A | B | C | D |
| Detergent | 1200 | 1200 | 1200 | 1200 |
| ZPS | 0.00 | 0.50 | 0.00 | 0.50 |
| DTPA | 0.00 | 0.00 | 50.00 | 50.00 |

| Cleaning Measured by an Expert Panel: | | | |
|---|---|---|---|
| | Panel Score Unit (PSU) | | |
| Test Solution | B | C | D |
| Control Solution | A | A | A |
| First wash cycle | 0.33 | 0.22 | 1.07s |

| Cleaning Measured as variation in Whiteness Index (WI): | | | | |
|---|---|---|---|---|
| | WI(A) | WI(B) | WI(C) | WI(D) |
| Initial | 49.87 | 50.12 | 50.86 | 50.77 |
| First wash cycle | 71.08 | 71.35 | 70.92 | 73.91 |
| variation | 21.20 | 21.23 | 20.06 | 23.14 |

s: means significant differences versus control

The larger value of Whiteness Index, the whiter the fabric.

STAIN REMOVAL

Coffee stains are tested for stain removal comparing the performance of the photobleach-chelant system versus no chelant/photobleach, photobleach, and chelant. Coffee stained fabrics are washed in 2000 ppm detergent solution on which was added: (A) no addition, (B) 0.5 ppm of zinc phthalocyanine sulfonate (ZPS), (C) 50 ppm of pentasodium diethylenetriamine pentaacetate salt (DTPA), and (D) 0.5 ppm zinc phthalocyanine sulfonate (ZPS) and 50 ppm of pentasodium diethylenetriamine pentaacetate salt (DTPA).

Procedure: Coffee stained fabrics (three internal and two external comparisons) are soaked for 30 minutes in their respective solutions and then agitated for 15 minutes. A miniwasher is used for this test. The water hardness is 12 grains per gallon. The fabrics are rinsed and line dried under natural light in the shadow.

Cleaning Measurement: Coffee stains are compared for stain removal performance using an expert panel of three graders using Panel Score Unit (PSU) scale.

Results indicate that the DTPA-ZPS combination provides significantly better stain removal performance than ZPS/no-DTPA and no-ZPS/DTPA as shown by significant Panel Score Unit and large delta L and Whiteness Index differences.

| Results: | | | | |
|---|---|---|---|---|
| | Wash Solution Composition (ppm) | | | |
| | A | B | C | D |
| Detergent | 1200 | 1200 | 1200 | 1200 |
| ZPS | 0.00 | 0.50 | 0.00 | 0.50 |
| DTPA | 0.00 | 0.00 | 50.00 | 50.00 |

-continued

Stain Removal Measured by an Expert Panel:

| | Panel Score Unit (PSU) | | |
|---|---|---|---|
| Test Solution | B | C | D |
| Control Solution | A | A | A |
| First wash cycle | 0.59 | 0.88 | 1.25s |

s: means significant differences versus control

ANALYTICAL RESULTS

The formation of a photobleach-chelant complex (phthalocyanine sulfonate (ZPS)/pentasodium diethylenetriamine pentaacetate salt (DTPA) in solution is evidenced by the increase in the characteristic ZPS absorbency at 668 nm when adding chelant. This also indicates that the ZPS/DTPA complex has a lower activation energy/molecule than ZPS alone.

Procedure: Solutions of 0.25 ppm, 0.50 ppm and 1.00 ppm of zinc phthalocyanine sulfonate (ZPS) are measured for absorbency. An aliquot of pentasodium diethylenetriamine pentaacetate salt (DTPA) is added to increase the DTPA concentration to 10, 20, 50, 100 and 250 ppm. Absorbency is measured for each point once it reached equilibrium. The apparatus used is a UVNIS Diode Array spectrophotometer, model HP 8452A. Results are as follows:

| ppm ZPS | ppm DTPA | Absorbency (at 668 nm) | Difference vs. 0.0 ppm DTPA |
|---|---|---|---|
| — | 100 | 0.0000 | — |
| 0.25 | 0 | 0.0393 | — |
| 0.25 | 10 | 0.0434 | 0.0041 |
| 0.25 | 20 | 0.0438 | 0.0045 |
| 0.25 | 50 | 0.0515 | 0.0122 |
| 0.25 | 100 | 0.0562 | 0.0169 |
| 0.25 | 250 | 0.0661 | 0.0268 |
| — | 100 | 0.0000 | — |
| 0.50 | 0 | 0.0841 | — |
| 0.50 | 10 | 0.0916 | 0.0075 |
| 0.50 | 20 | 0.0937 | 0.0096 |
| 0.50 | 50 | 0.0894 | 0.0053 |
| 0.50 | 100 | 0.0882 | 0.0041 |
| 0.50 | 250 | 0.0988 | 0.0147 |
| — | 100 | 0.0000 | — |
| 1.00 | 0 | 0.1225 | — |
| 1.00 | 10 | 0.1436 | 0.0211 |
| 1.00 | 20 | 0.1462 | 0.0237 |
| 1.00 | 50 | 0.1468 | 0.0243 |
| 1.00 | 100 | 0.1510 | 0.0285 |
| 1.00 | 250 | 0.2192 | 0.0967 |

The cleaning compositions provided in accordance with this invention may be in the form of granules, liquids, bars, and the like, and typically are formulated to provide an in-use pH in the range of 9 to 11. Various carriers such as sodium sulfate, water, water-ethanol, sodium carbonate, and the like, may be used routinely to formulate the finished products. Granules may be produced by spray-drying or by agglomeration, using known techniques, to provide products in the density range of 350–950 g/l. Bars may be formulated using conventional extrusion techniques. The photobleach-chelant may be pre-formed, if desired. The compositions may also contain conventional perfumes, bactericides, hydrotropes and the like. Non-limiting examples of compositions according to this invention are as follows:

EXAMPLE I

| Ingredients | % (wt.) A | % (wt.) B | % (wt.) C | % (wt.) D |
|---|---|---|---|---|
| Sodium LAS | 15 | 30 | 20 | 25 |
| NEODOL | 1 | 1 | 1 | 1 |
| Alkyl Dimethyl Ammonium Chloride | 0.5 | 1 | 0.5 | 0.7 |
| Sodium Tripolyphosphate | 15 | 35 | 22 | 28 |
| Sodium Carbonate | 10 | 10 | 15 | 15 |
| SOKALAN | 2 | 2 | 2 | 2 |
| Carboxymethyl Cellulose | 1 | 1 | 1 | 1 |
| Tinopal CBS-X | 0.1 | 0.1 | 0.1 | 0.1 |
| Soil Release Agent* | 0.2 | 0.2 | 0.3 | 0.3 |
| Savinase 6.0T | 0.3 | 0.6 | 0.5 | 0.6 |
| BAN 300T | 0.2 | 0.5 | 0.5 | 0.6 |
| Lipolase 100T | 0.1 | 0.2 | 0.2 | 0.3 |
| CAREZYME 5T | 0.1 | 0.2 | 0.2 | 0.3 |
| Sodium Perborate | — | — | 3.0 | 5.0 |
| NOBS | — | — | 2.0 | 3.0 |
| DTPA | 0.4 | 1.5 | 2.0 | 3.0 |
| ZPS | 0.005 | 0.010 | 0.008 | 0.01 |

Moisture + Sodium Sulfate + Perfume + Miscellaneous Balance Balance Balance Balance

*End-capped oligomer of terephthaloyl units (T), sulfoisophthaloyl units (SI), oxyethyleneoxy units and oxy-1,2-propylene units (E/P) forming the backbone of the oligomer, and preferably terminated with modified isethionate end-caps (CAP). Specifically, the soil release agent comprises on a molar basis about one SI unit, 5 T units, 5 E/P units in a ratio of from about 1.7 to about 1.8, and two CAP units of sodium 2-(2-hydroxyethoxy)-ethanesulfonate. The soil release agent may be homogenously mixed with about 0.5% to about 20%, by weight of the oligomer, of a crystallinity-reducing stabilizer, preferably selected from the group consisting of xylene sulfonate, cumene sulfonate, toluene sulfonate, and mixtures thereof.

Fabrics are laundered using the foregoing compositions, typically at usage concentrations of from about 10 ppm to about 10,000 ppm. The fabrics are dried in the presence of light, preferably natural sunlight, to achieve improved photobleaching benefits.

What is claimed is:

1. A method for providing improved photobleach activity to a fabric in an otherwise conventional fabric photobleaching or laundering process, comprising:

(a) soaking the fabric in an aqueous bath that comprises:

(1) a metal phthalocyanine photobleach compound at a concentration in the range from about 0.02 ppm to about 2.0 ppm; and (2) a chelant selected from diethylene triamine pentaacetate, diethylene triamine penta(methylene phosphonate), and mixtures thereof at a concentration in the range from about 30 ppm to about 400 ppm;

(b) exposing the fabric, while wetted by the aqueous bath, to light.

2. The method of claim 1 wherein the photobleach is selected from the group consisting of zinc phthalocyanines and aluminum phthalocyanines.

3. The method of claim 2 wherein the photobleach is a sulfonated zinc or aluminum phthalocyanine.

4. A bleaching composition comprising a photobleach and a chelant, characterized in that:

(a) the photobleach is a metal phthalocyanine compound present in a concentration range of from about 0.0005% to about 0.05%, by weight; and (b) the chelant is selected from diethylene triamine pentaacetate, diethylene triamine penta(methylene phosphonate), and mixtures thereof about 0.3% to about 10.0%, by weight.

5. The composition of claim 1 wherein the photobleach is selected from the group consisting of zinc phthalocyanines and aluminum phthalocyanines, and is present at a concentration range from about 0.002% to about 0.015%.

6. The composition of claim 5 wherein the photobleach is a sulfonated zinc or aluminum phthalocyanine.

7. A composition for laundering fabrics with improved photobleaching effect, characterized in that it comprises:

(a) from about 0.0005% to about 0.05%, by weight, of a metal phthalocyanine photobleach compound;

(b) from about 0.3% to about 10.0%, by weight, of a chelant selected from diethylene triamine pentaacetate, diethylene triamine penta(methylene phosphonate), and mixtures thereof;

(c) at least about 1%, by weight, of a detersive surfactant; and (d) the balance of the composition comprising adjunct detersive ingredients and carriers.

8. The composition of claim 7 wherein the photobleach is selected from the group consisting of zinc phthalocyanines and aluminum phthalocyanines, and is present at a concentration range from about 0.002% to about 0.015%.

9. The composition of claim 8 wherein the photobleach is a sulfonated zinc or aluminum phthalocyanine.

* * * * *